US010208541B2

(12) United States Patent
Hoelting et al.

(10) Patent No.: US 10,208,541 B2
(45) Date of Patent: Feb. 19, 2019

(54) PULLBACK SYSTEM FOR DRILLING TOOL

(71) Applicant: Vermeer Manufacturing Company, Pella, IA (US)

(72) Inventors: Keith A. Hoelting, Dallas, IA (US); Andrew James Kreimeyer, Knoxville, IA (US)

(73) Assignee: Vermeer Manufacturing Company, Pella, IA (US)

( * ) Notice: Subject to any disclaimer, the term of this patent is extended or adjusted under 35 U.S.C. 154(b) by 114 days.

(21) Appl. No.: 15/232,345

(22) Filed: Aug. 9, 2016

(65) Prior Publication Data

US 2017/0044835 A1 Feb. 16, 2017

Related U.S. Application Data

(60) Provisional application No. 62/326,606, filed on Apr. 22, 2016, provisional application No. 62/294,802, filed on Feb. 12, 2016, provisional application No. 62/203,151, filed on Aug. 10, 2015.

(51) Int. Cl.

| | |
|---|---|
| ***E21B 7/28*** | (2006.01) |
| ***E21B 10/62*** | (2006.01) |
| ***E21B 10/42*** | (2006.01) |
| ***E21B 7/04*** | (2006.01) |
| ***E21B 7/06*** | (2006.01) |
| ***E21B 7/20*** | (2006.01) |
| ***E21B 47/024*** | (2006.01) |

(52) U.S. Cl.

CPC ..... *E21B 10/42* (2013.01); *E21B 7/046* (2013.01); *E21B 7/064* (2013.01); *E21B 7/20* (2013.01); *E21B 47/024* (2013.01)

(58) Field of Classification Search

CPC . E21B 7/28; E21B 10/62; E21B 7/046; E21B 7/064; E21B 7/20

USPC ..... 405/184

See application file for complete search history.

(56) References Cited

U.S. PATENT DOCUMENTS 2,225,128 A * 12/1940 Osborn ..... F16B 7/182 403/215
4,270,618 A 6/1981 Owens
4,507,019 A 3/1985 Thompson
4,679,637 A 7/1987 Cherrington et al.
4,738,565 A 4/1988 Streatfield et al.

(Continued)

OTHER PUBLICATIONS

European Search Report for European Application No. 16182804 dated Nov. 28, 2016.

(Continued)

*Primary Examiner* — Cathleen R Hutchins
(74) *Attorney, Agent, or Firm* — Merchant & Gould P.C.

(57) ABSTRACT

A pullback system for a drilling tool includes features to retain a pulling cable. The drilling tool includes a drill bit body for carrying a plurality of cutting teeth. The drill bit body has a first side and an opposite second side. The drill bit body also defines a first pullback device passage that extends through the drill bit body from the first side to the second side. The first pullback device passage extends generally along a passage axis that extends through the drill bit body. The first pullback device passage includes at least a portion adjacent to the first side that curves as the surface extends in a direction along the passage axis. The passage axis is positioned along a reference plane that generally bisects the drill bit body.

13 Claims, 18 Drawing Sheets

FIG. 6

(56) References Cited

U.S. PATENT DOCUMENTS

| | | | | |
|---|---|---|---|---|
| 4,784,230 | A | 11/1988 | Cherrington et al. | |
| 4,785,885 | A | 11/1988 | Cherrington et al. | |
| 4,911,579 | A | 3/1990 | Lutz et al. | |
| 5,033,907 | A | 7/1991 | O'Donnell et al. | |
| 5,192,165 | A | 3/1993 | Torielli | |
| 5,651,647 | A | 7/1997 | Ray | |
| 6,098,708 | A | 8/2000 | Jenne | |
| 6,109,832 | A | 8/2000 | Lincoln | |
| 6,260,634 | B1 | 7/2001 | Wentworth et al. | |
| 6,305,880 | B1 | 10/2001 | Carter et al. | |
| 6,443,658 | B1 | 9/2002 | Lincoln | |
| 7,243,737 | B2 | 7/2007 | Michael | |
| 7,318,491 | B2 | 1/2008 | Riel | |
| 7,845,432 | B2 | 12/2010 | Salins et al. | |
| 7,976,243 | B2 | 7/2011 | Rohde et al. | |
| 8,033,345 | B1 | 10/2011 | Randall et al. | |
| 8,122,979 | B1 * | 2/2012 | Wright, Jr. ..... | E21B 10/62 175/398 |
| 8,312,938 | B2 | 11/2012 | Biggs et al. | |
| 8,365,841 | B2 | 2/2013 | Dimitroff | |
| 8,529,156 | B2 | 9/2013 | Biggs et al. | |
| 8,544,569 | B2 | 10/2013 | Wright et al. | |
| 9,169,946 | B2 | 10/2015 | Crane et al. | |
| 2002/0112890 | A1 | 8/2002 | Wentworth et al. | |
| 2003/0106714 | A1 | 6/2003 | Smith et al. | |
| 2012/0043132 | A1 | 2/2012 | Crane | |
| 2014/0255103 | A1 * | 9/2014 | Crane ..... | E21B 7/064 405/184 |
| 2014/0367175 | A1 | 12/2014 | Cooper | |
| 2015/0233183 | A1 | 8/2015 | Melsheimer | |

OTHER PUBLICATIONS

Railhead Underground Products, LLC, Product Catalog, May 2013, Cover pgs, Table of Contents, p. 1 (4 pgs total).

Melfred Borzall's Directional Depot, Product Catalog, vol. 9, Issue 1, 2012, Covers, pp. 56, 58 (4 pgs total).

Design & Manufacturing Ltd, 2014 Catalog for HDD Pullback Swivels (14 pgs).

Design & Manufacturing Ltd, 2014 Catalog for Cable Pulling Eyes (2 pgs).

HDD Showcase, "Got an HDD project that works? Here, four manufacturers highlight their HDD products," Utility Contractor Online, Safety & Training, Mar. 17, 2014 (4 pgs).

Trenchless Technology, Special Supplement, "Horizontal Directional Drilling Guide," Jul. 17, 2015, p. 39 (40 pgs total).

* cited by examiner

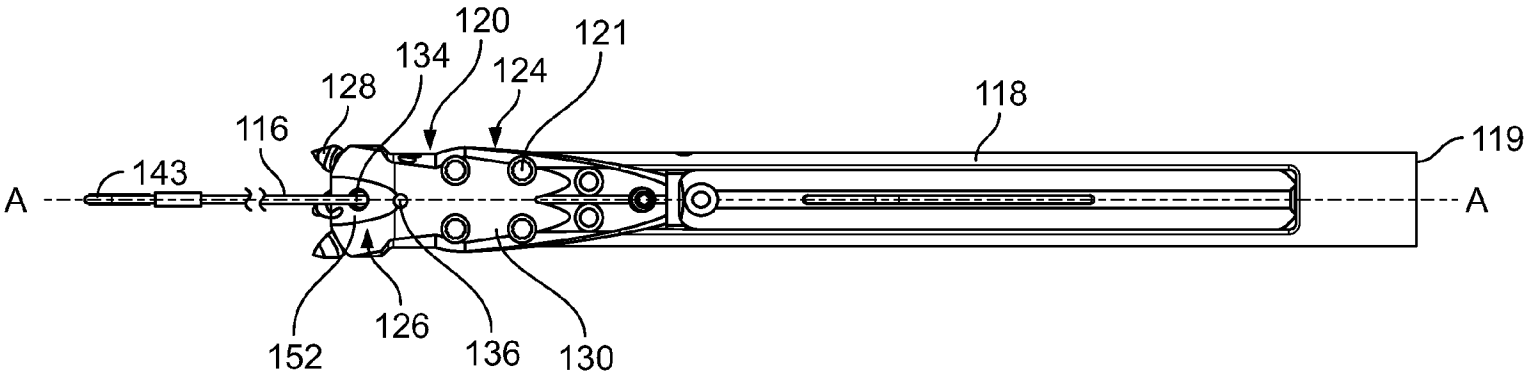
FIG. 4
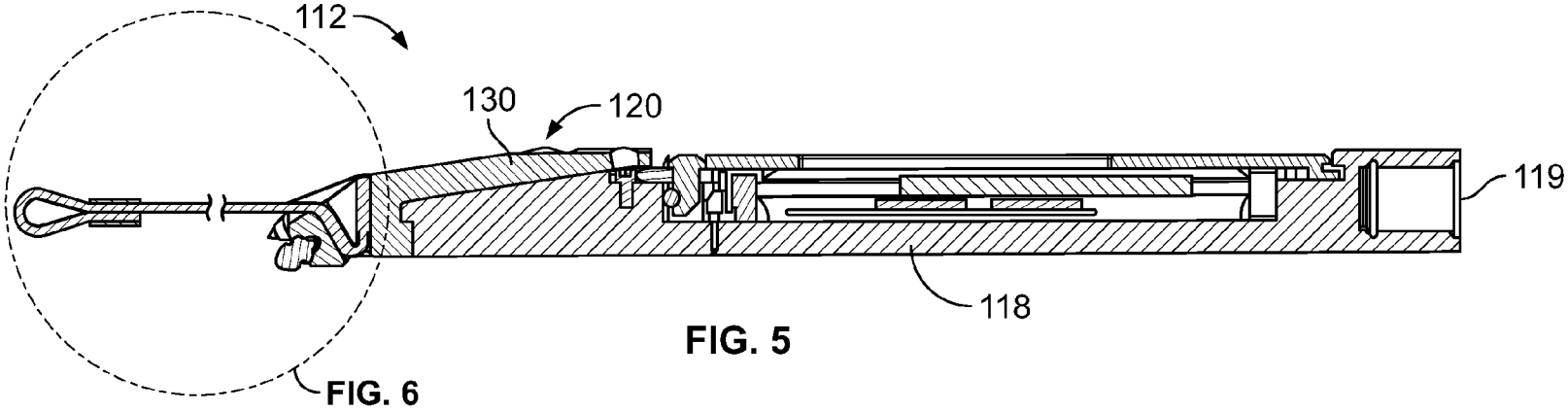
FIG. 5
FIG. 6

PULLBACK SYSTEM FOR DRILLING TOOL

CROSS-REFERENCE TO RELATED APPLICATIONS

This application claims the benefit of U.S. Provisional Patent Application Ser. Nos. 62/326,606, filed Apr. 22, 2016; 62/294,802, filed Feb. 12, 2016; and 62/203,151, filed Aug. 10, 2015, which applications are hereby incorporated by reference in their entirety.

BACKGROUND

In traditional Horizontal Directional Drilling ("HDD") applications, a pilot hole is drilled in the ground on a general horizontal path by a HDD machine. The HDD machine rotates and thrusts a drill bit attached to the end of a series of drill pipes, known as the drill string, to complete the pilot hole. Once the pilot hole is complete, a reamer or "hole opener" is pulled back through the pilot hole, increasing the size of the pilot hole so that a particular sized product (e.g., a conduit) can be positioned within the hole.

However, for certain applications, the product that is being placed within the ground is smaller than, or the same size as, the pilot hole. This allows the product to be pulled back through, and positioned within, the pilot hole without the need for reaming. This is advantageous to the operator as time can be saved by not having to ream the pilot hole. To pull product back through the pilot hole, a drill bit, or a portion thereof, is often removed from the drill string to allow for the attachment of a pullback device that interfaces with the product that is being positioned within the pilot hole. However, this process can be time consuming and requires additional tooling to complete the overall pullback process.

Therefore, improvements are desired.

SUMMARY

The present disclosure relates generally to a pullback system for a drilling tool. In one possible configuration, and by non-limiting example, a pulling cable is removably secured within the drilling tool, specifically the drill bit.

In one aspect of the present disclosure, a drilling tool is disclosed. The drilling tool includes a drill bit body for carrying a plurality of cutting teeth. The drill bit body has a first side and an opposite second side. The drill bit body also defines a first pullback device passage that extends through the drill bit body from the first side to the second side. The first pullback device passage extends generally along a passage axis that extends through the drill bit body. The first pullback device passage includes at least a portion adjacent to the first side that curves as the surface extends in a direction along the passage axis. The passage axis is positioned along a reference plane that generally bisects the drill bit body.

In another aspect of the present disclosure, a method of securing a pulling cable to a drilling tool is disclosed. The method includes routing an end of the pulling cable though a first passage disposed within the drilling tool. The first passage includes a passage axis that is positioned along a reference plane that generally bisects the drilling tool. The method also includes bending the pulling cable at the end of the pulling cable that has been routed through the first passage. The method further includes routing the end through a second passage disposed within the drilling tool to provide retention of the pulling cable within the drilling tool.

In still another aspect of the present disclosure, a drilling tool is disclosed. The drilling tool includes a drill bit body that carries a plurality of cutting teeth. The drill bit body includes a first side and an opposite second side. The drill bit body also defines a first pulling cable passage that extends through the drill bit body from the first side to the second side. The first pulling cable passage extends generally along a passage axis that extends through the drill bit body. The passage axis is positioned along a reference plane that generally bisects the drill bit body. The drilling tool also includes a second pulling cable passage that extends through the drill bit body in a direction that extends from the second side toward the first side.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

FIG. 4 illustrates a top view of the drilling tool of FIG. 2;

FIG. 5 illustrates a cross-sectional view of the drilling tool along reference plane A in FIG. 4;

DETAILED DESCRIPTION

Figure 1:
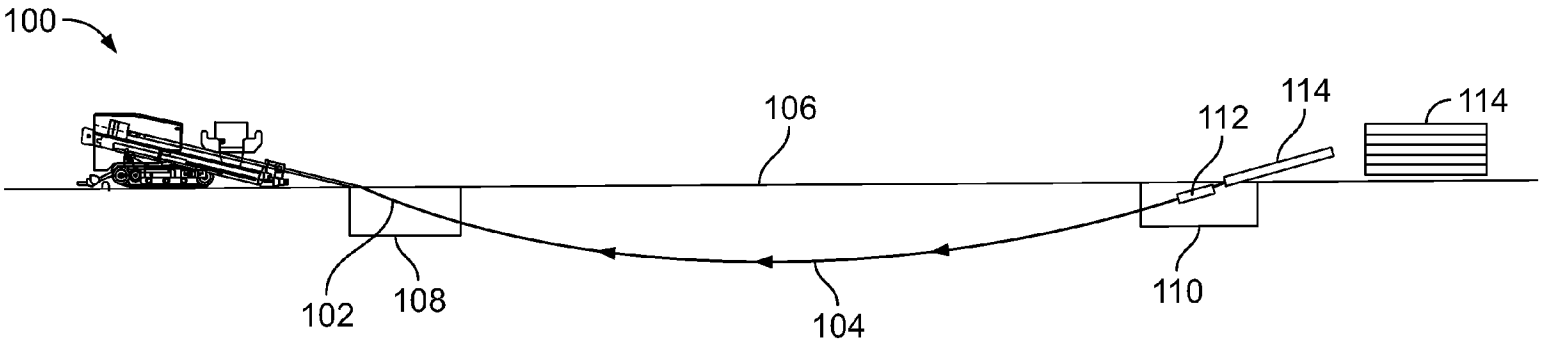
FIG. 1 illustrates a schematic side view of a HDD operation, according to one aspect of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

The present disclosure pertains to a pullback system for a drilling tool in a HDD system. The pullback system includes a drilling tool that is configured to receive a pulling cable for attaching an underground product. The drilling tool does not require a specialized tool to attach the cable, nor does any part of the drilling tool need to be removed, or any collar attached thereto, prior to attaching the pulling cable. This allows the underground product to be quickly attached to the drilling tool for a pullback action.

FIG. 1 shows a schematic representation of a HDD operation. As shown, a HDD machine 100 is operating a drill string 102 underground along a bore path 104. The bore path 104 defines a pilot bore. The drill string 102 enters the ground 106 at an entry pit 108 and exits the ground 106 at an exit pit 110. While underground, the drill string 102 follows a generally horizontal path. The drill string 102 includes a drilling tool 112 attached to the distal end thereof. Attached to the drilling tool 112 is an underground product 114.

As shown, the HDD machine 100 has completed the drilling of the pilot bore and, as shown by the arrows along the bore path 104, a pullback action is being commenced where the HDD machine is pulling the drill string 102 in a direction back toward the HDD machine 100. Once the HDD machine 100 completes the pullback action, the drilling tool 112 will be in the entry pit 108, and the underground product 114 will be positioned within the pilot bore. In the depicted embodiment, the underground product 114 is a conduit sized similarly to the size of the pilot bore. In other embodiments, the underground product 114 is a cable.

Figure 2:
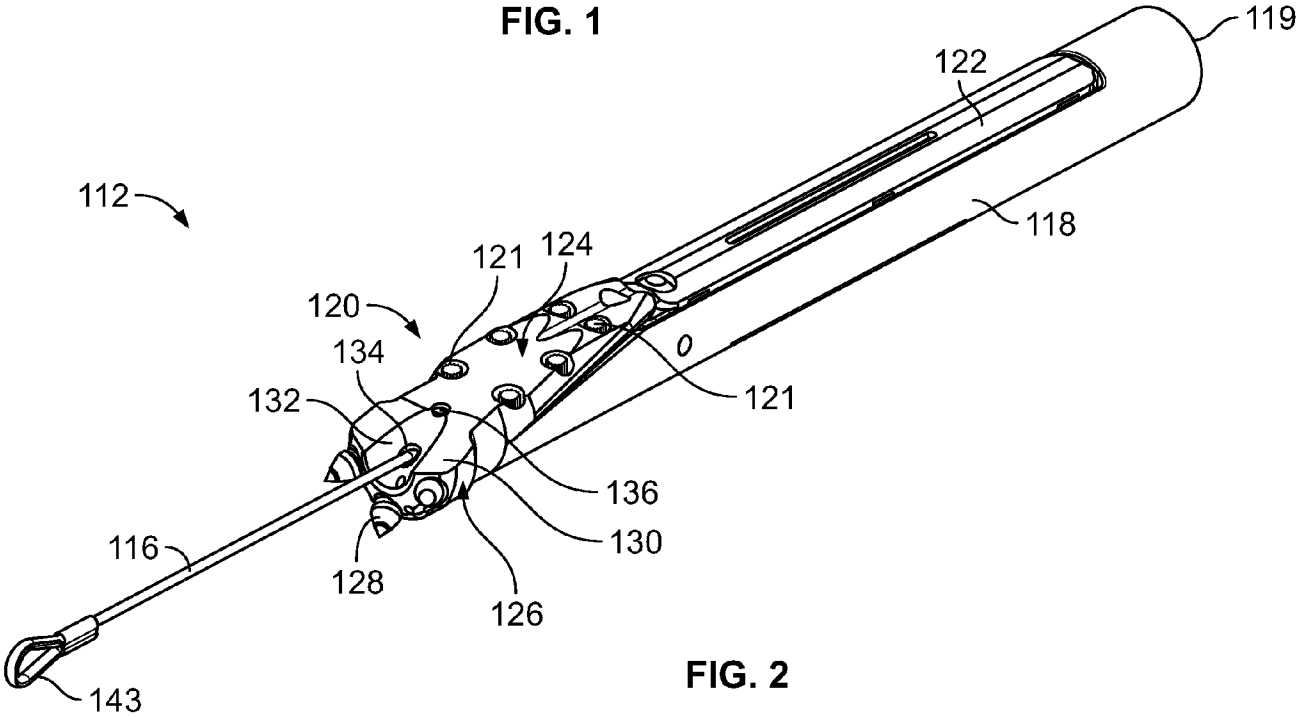
FIG. 2 illustrates a front perspective view of a drilling tool, according to one aspect of the present disclosure.
Figure 3:
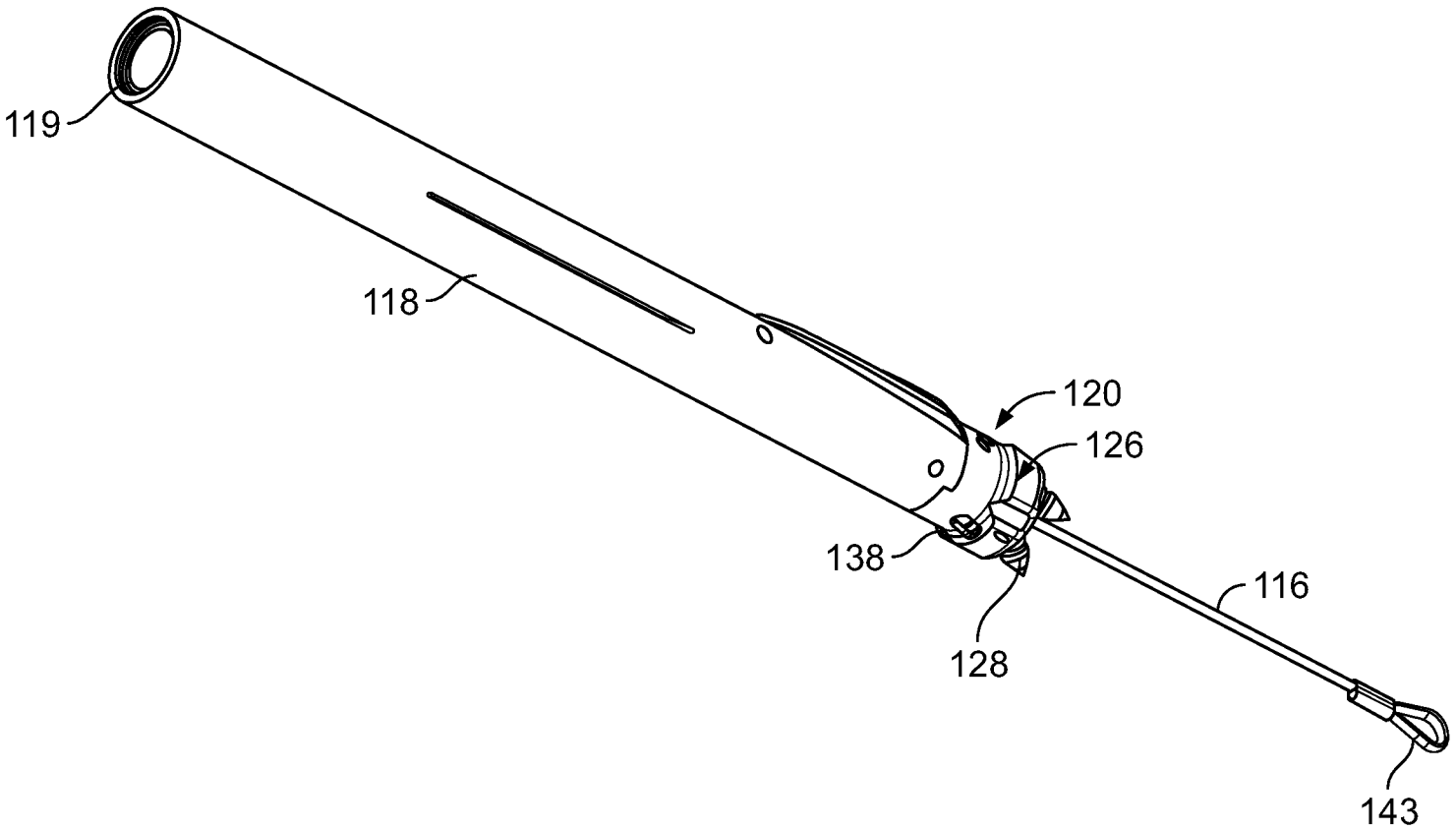
FIG. 3 illustrates a rear perspective view of the drilling tool of FIG. 2.

FIGS. 2 and 3 show top and bottom perspective views of the drilling tool 112. As shown, attached to the drilling tool 112 is a pulling cable 116. The drilling tool 112 includes a sonde housing 118 and a drill bit 120 that mounts to the sonde housing 118. The drilling tool 112 is configured to be removably attached to the distal end of the drill string 102 such that the drill string 102 can be used to rotate the drilling tool 112 in a rotational cutting motion about a central axis of rotation of the drill string 102.

The sonde housing 118 is configured for holding a sonde (not shown) used to monitor operational parameters of the drilling tool 112 such as pitch and rotational orientation (i.e., roll position or clock position). The sonde can also work with other equipment to allow a geographic position of the drilling tool 112 to be determined. The sonde typically interfaces with a control system that is used to control the direction in which the drilling tool 112 travels. The sonde can be secured in a compartment of the sonde housing 118 and accessed by removing a cover 122. The sonde housing 118 can be configured to allow side loading of the sonde, end loading of the sonde, or other loading configurations.

As shown, the sonde housing 118 is configured to be attached the drill string 102 at a proximal end 119. In some embodiments, the proximal end 119 of the sonde housing 118 is threaded to receive a threaded portion of the drill string 102 (i.e., a drill rod). In some embodiments, the sonde housing 118 has a similar cross-sectional area compared to that of the drill string 102.

The drill bit 120 is mounted to the sonde housing 118 by a plurality of bolts 121, opposite the proximal end 119 of the sonde housing 118. The drill bit 120 of the drilling tool 112 comprises a main body 124 and a head portion 126 that includes a plurality of replaceable cutting teeth 128. The cutting teeth 128 are mounted to the head portion 126 and are allowed to rotate about the cutting teeth central axes during drilling operations.

The drill bit 120 further defines an angled face 130 (i.e., a ramp surface) that faces at least partially in the distal direction. In some embodiments, the angled face 130 is used to facilitate steering of the drilling tool 112. Also shown, a face recess 132 is defined within the angled face 130.

As shown, the drill bit 120 is also configured to receive a portion of the pulling cable 116. The drill bit 120 receives the pulling cable 116 at a first pulling cable passage 134 located within the face recess 132. The drill bit 120 further includes a second pulling cable passage 136 and a cable recess 138 positioned at a bottom side 142 of the drill bit 120. The cable recess 138, as shown in FIG. 3, joins the first and second pulling cable passages 134, 136.

Figure 6:
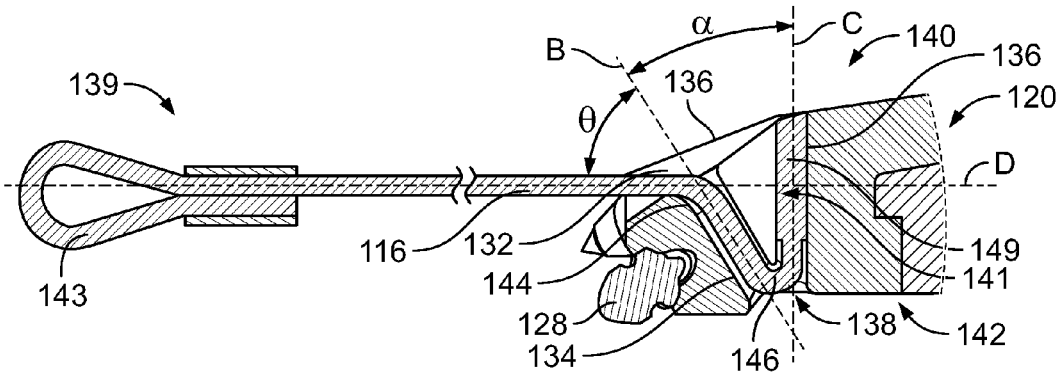
FIG. 6 illustrates a portion of the cross-sectional view of the drilling tool in FIG. 5.
Figure 9:
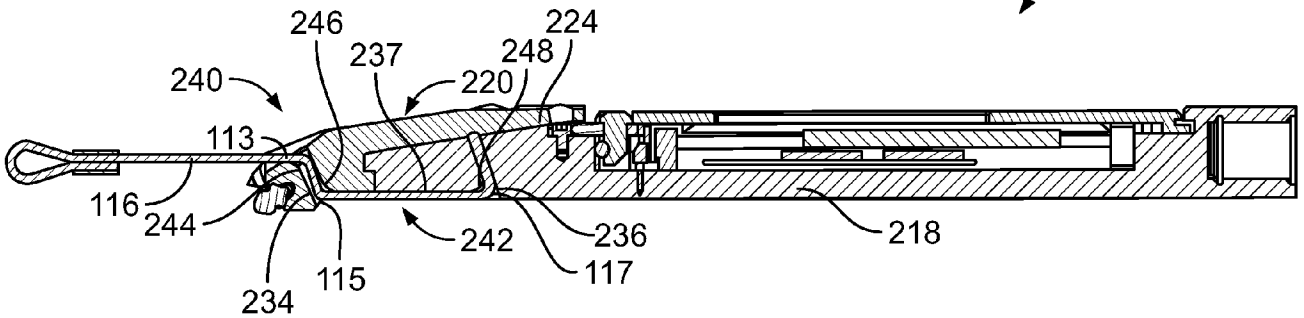
FIG. 9 illustrates a cross-sectional side view of a drilling tool, according to one aspect of the present disclosure.

The pulling cable 116 is shown to be secured within the drilling tool 112. The pulling cable 116 is, in one variant, a steel cable and includes a first end 139 that includes a pulling loop 143 and a second end 141 that is secured within the drilling tool 112. In some embodiments, a collar 149 (as shown in FIG. 6) is attached to the second end 141 to prevent the cable from inadvertently unraveling. In other embodiments, the pulling cable 116 is also secured within the sonde housing 118 (as shown in FIG. 9).

FIG. 4 shows a top view of the drilling tool 112. Specifically, a reference plane A is shown to bisect the drilling tool 112. The pulling cable 116 is shown positioned along reference plane A. Aligning the pulling cable 116 along the bisector reference plane A helps to promote an even pulling load along the length of the drilling tool 112.

FIGS. 5-6 show a cross-sectional view of the drilling tool 112 along reference plane A. The drill bit 120 is shown attached to the sonde housing 118. As shown in FIG. 6, the pulling cable 116 is secured within the first and second pulling cable passages 134, 136.

The first pulling cable passage 134 is shown to extend through the drill bit 120 from the face recess 132 of a top side 140 of drill bit 120 to the bottom side 142. The first pulling cable passage 134 extends generally along a first passage axis B that extends through the drill bit 120 and is positioned at an angle θ with a longitudinal axis D of the drilling tool 112. The first pulling cable passage 134 also includes a curved portion 144 adjacent to the top side 140 that curves as the surface extends in a direction along the first passage axis B. The first passage axis B is positioned along reference plane A that generally bisects the main body 124 of the drill bit 120.

The curved portion 144 is configured to prevent unnecessary friction between the pulling cable 116 and the drill bit 120 and to avoid the provision of a stress riser for the pulling cable 116 at the point of entry into the drill bit 120. Unnecessary friction and/or the provision of a stress riser (e.g., in the form of a corner and/or a sharp angle) could lead to weakening of the cable, possibly leading to a failure. In some embodiments, a low friction insert and/or coating (not shown) may be in first pulling cable passage 134 to reduce friction between the pulling cable 116 and the drill bit 120 at the opening of the first pulling cable passage 134 within the face recess 132.

Figure 7:
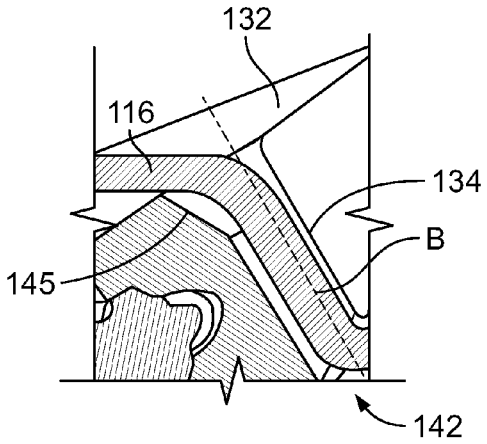
FIG. 7 illustrates a cross-sectional view of a drill bit of a drilling tool, according to one embodiment of the present disclosure.
Figure 8:
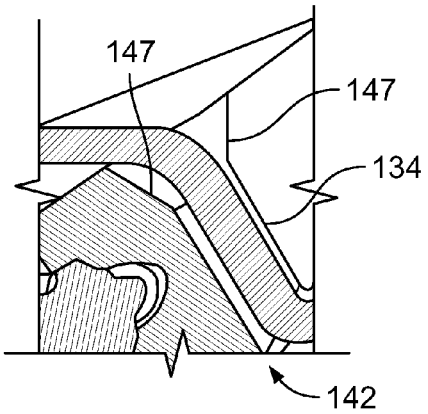
FIG. 8 illustrates a cross-sectional view of a drill bit of a drilling tool, according to one embodiment of the present disclosure.

As shown in FIG. 7, in some embodiments, a beveled portion 145 is used instead of a curved portion 144. The beveled portion 145 can be a flat surface that is not perpendicular to the first passage axis B and extends from the first pulling cable passage 134 to the face recess 132 along the portion of the first pulling cable passage 134 closest to the bottom side 142. In other embodiments, as shown in FIG. 8, the first pulling cable passage 134 may have a countersunk portion 147.

Referring again to FIG. 6, the second pulling cable passage 136 extends through the drill bit 120 in a direction from the angled face 130 of top side 140 toward the bottom side 142. As shown, the second pulling cable passage 136 extends generally along a second passage axis C that is perpendicular to the longitudinal axis D of the drilling tool 112. However, in some embodiments, second pulling cable passage 136 is oriented at an angle with the longitudinal axis D.

In some embodiments, the first passage axis B and the second passage axis C are parallel with one another. In other embodiments, the first passage axis B and the second passage axis C form an angle α with one another. In some embodiments, the angle α is between about 30 degrees and about 60 degrees. In other embodiments, the angle α is about 45 degrees.

The cable recess 138 is positioned at the bottom side 142 of the drill bit 120 and extends between and connects the first and second pulling cable passages 134, 136. The cable recess 138 has edges that have a rounded profile to prevent unnecessary friction and a limited stress riser between the pulling cable 116 and the drill bit 120. Further, due to the presence of the cable recess 138, when the pulling cable 116 is in position thereat, the pulling cable 116 does not extend out beyond the bottom side 142 or may even be within the confines of the bottom side 142. Such a configuration permits the bottom side 142 of the drill bit 120 to offer a level of protection to the pulling cable 116 during the pullback procedure.

As shown, the pulling cable 116 enters first through the first pulling cable passage 134 at the top side 140 of the drill bit 120. The pulling cable 116 is then looped/bent into a looped portion 146 within the cable recess 138 and then passed through the second pulling cable passage 136. In the depicted embodiment, the second end 141 of the pulling cable 116 remains completely within the second pulling cable passage 136. In other embodiments, the second end 141 can pass out of the second pulling cable passage 136. In some embodiments, looped portion 146 of the pulling cable 116 turns an amount in the range of 120 to 240 degrees between the first and second pulling cable passages 134, 136. The looped portion 146 allows the pulling cable 116 to be retained within the drilling tool 112 even under an axial load during a pullback action. Additionally, no additional retaining devices are needed to retain the cable within the drill bit 120, thereby lowering the cost of the solution and simplifying installation and removal of the pulling cable 116 and drill bit 120 from one another. However, in some embodiments, the drill bit 120 includes only a first pulling cable passage 134. In such an embodiment, a cable retaining device such as an oversized collar, can be used to retain the pulling cable 116 within the first pulling cable passage 134. As shown in FIG. 6, the pulling cable 116 includes a collar 149 that helps to prevent the pulling cable 116 from unraveling. The collar 149 can also be sized so that it creates a friction fit within the second pulling cable passage 136, further retaining the pulling cabling 116 within the drilling tool 112.

Now referring to FIG. 9, a cross-sectional view of a drilling tool 212, according to one embodiment of the present disclosure, is shown. The drilling tool 212 shares many similarities with the drilling tool 112 described above. However, the drilling tool 212 is configured to retain the pulling cable 116 within a drill bit 220 and a sonde housing 218. Specifically, the pulling cable 116 is routed from a top side 240 of the drilling tool 212 through a first passage 234 within the drill bit 220 and then into a second passage 236 within the sonde housing 218. In some embodiments, the second passage 236 may also pass into a body portion 224 of the drill bit 220. As shown, the pulling cable 116 rests within a groove 237 between the first and second passages 234, 236 on a bottom side 242 of the drilling tool 212, thereby minimizing the exposure of the pulling cable 116 to wear during the pullback process. The pulling cable 116 includes a first bend 113, a second bend 115, and a third bend 117. Each bend 113, 115, 117 helps to retain the pulling cable 116 within the drilling tool 212 even under an axial load. Like the curved portion 144 associated with previous embodiments, the first and second pulling cable passages 234, 236 can include curved and/or beveled surfaces 244, 246, 248 to reduce friction and/or stress risers between the drilling tool 212 and the pulling cable 116 at these locations.

Figure 10:
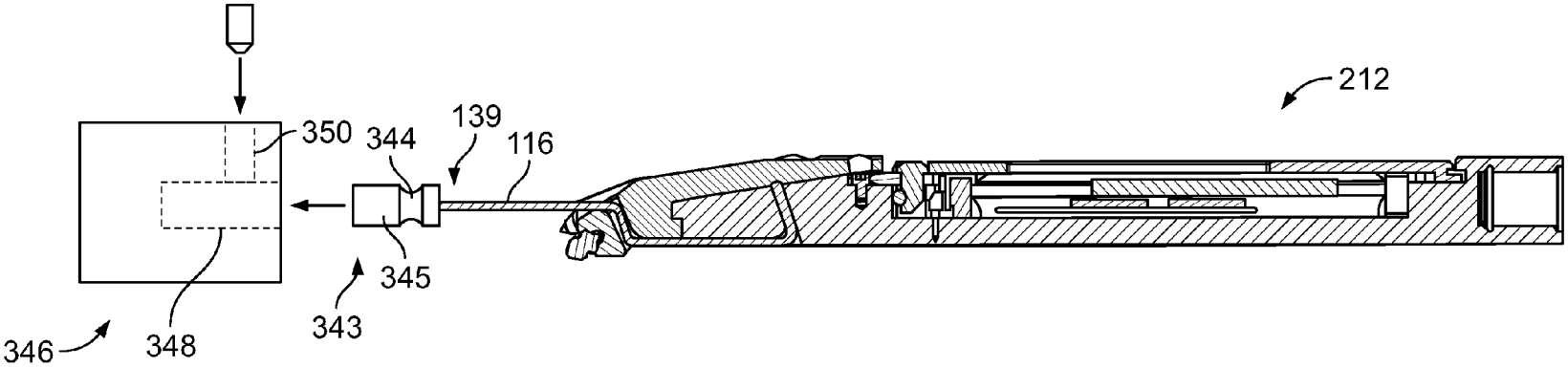
FIG. 10 illustrates a cross-sectional side view of a drilling tool and pullback adapter, according to one aspect of the present disclosure.

FIG. 10 shows an alternative embodiment according to the present disclosure. Specifically, an alternative for the loop 143 of the pulling cable 116, as shown in previous embodiments, is depicted. The pulling cable 116 is shown attached to the drilling tool 212; however, it can also be attached to the drilling tool 112 of previous embodiments.

As shown, a cylinder 343 is attached to the second end 139 of the pulling cable 116. The cylinder 343 is shown to include a groove 344 that is positioned around the surface 345 of the cylinder 343. The cylinder 343 is configured to be received by an adapter 346.

The adapter 346 is configured to interface with an underground product. The adapter 346 is also configured to rotate about the cylinder 343 as needed as the underground product is installed in a pullback operation. The adapter 346 includes a hole 348 that is sized similar to the cylinder 343 for receiving the cylinder 343. Additionally, the adapter 346 includes a cylinder retaining hole 350. In the depicted embodiment, the cylinder retaining hole 350 is threaded and configured to align with the groove 344 of the cylinder 343 when the cylinder is inserted into the hole 348. The cylinder retaining hole 350 is also configured to receive a set screw 352. In some embodiments, the set screw 352 is a cup point set screw. The set screw 352 is configured to be threaded into the cylinder retaining hole 350 until it is seated within the groove 344 of the cylinder 343. As the adapter 346 rotates about the cylinder 343 during a pullback operation, the set screw 352 travels within the groove 344 of the cylinder 343 so as to retain the cylinder 343 within the adapter 346 under an axial load while allowing rotational movement between the adapter 346 and the drilling tool 212.

Figure 11:
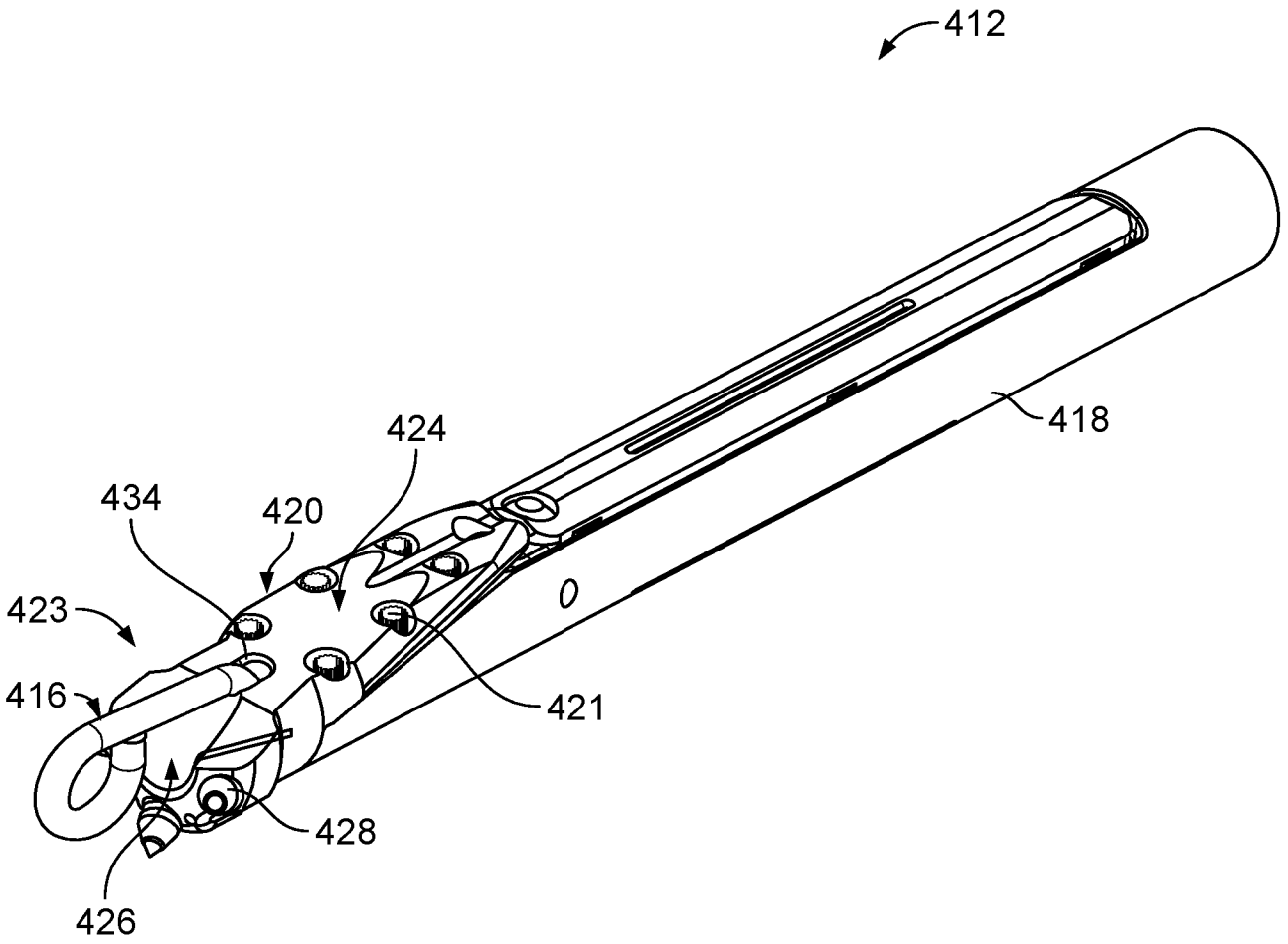
FIG. 11 illustrates a front perspective view of a drilling tool and pullback device, according to one aspect of the present disclosure.
Figure 12:
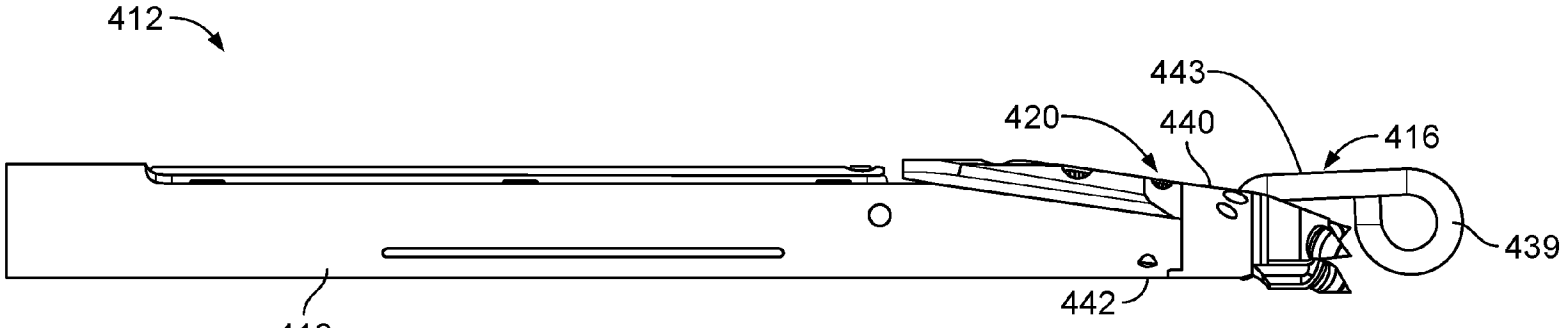
FIG. 12 illustrates a side view of the drilling tool and pullback device of FIG. 11.
Figure 13:
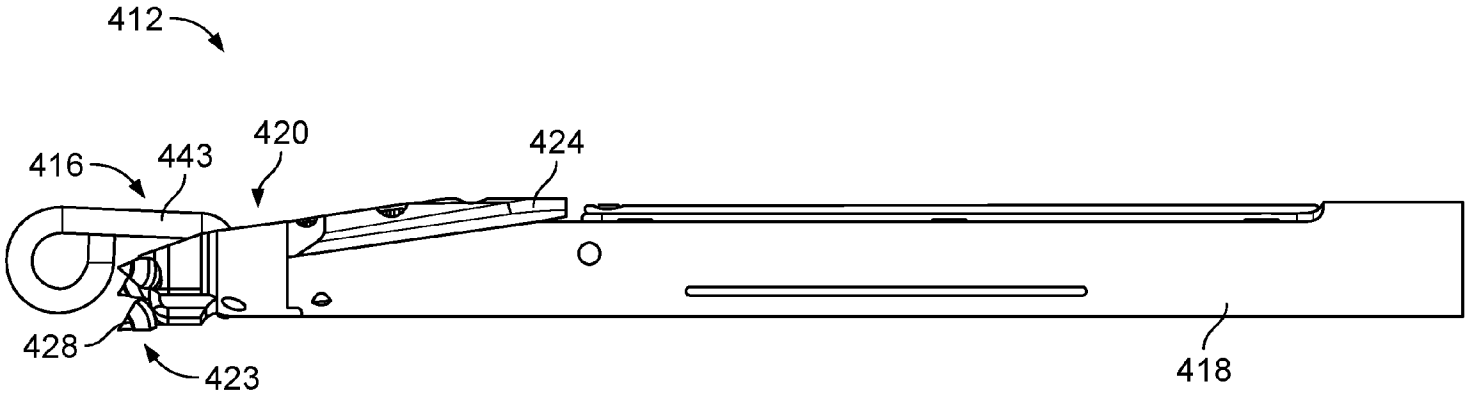
FIG. 13 illustrates another side view of the drilling tool and pullback device of FIG. 11.

Now referring to FIG. 11, a perspective view of a drilling tool 412, according to one embodiment of the present disclosure, is shown. The drilling tool 412 shares many similarities with the drilling tool 112 described above. However, the drilling tool 412 is configured receive a pullback device 416 in a pullback device passage 434. FIGS. 12-13 show side views of the drilling tool 412.

The drilling tool 412 includes a drill bit 420 mounted to a sonde housing 418 by a plurality of bolts 421 at a distal end 423. The drill bit 420 of the drilling tool 412 comprises a main body 424 and a head portion 426 that includes a plurality of replaceable cutting teeth 428.

Figure 14:
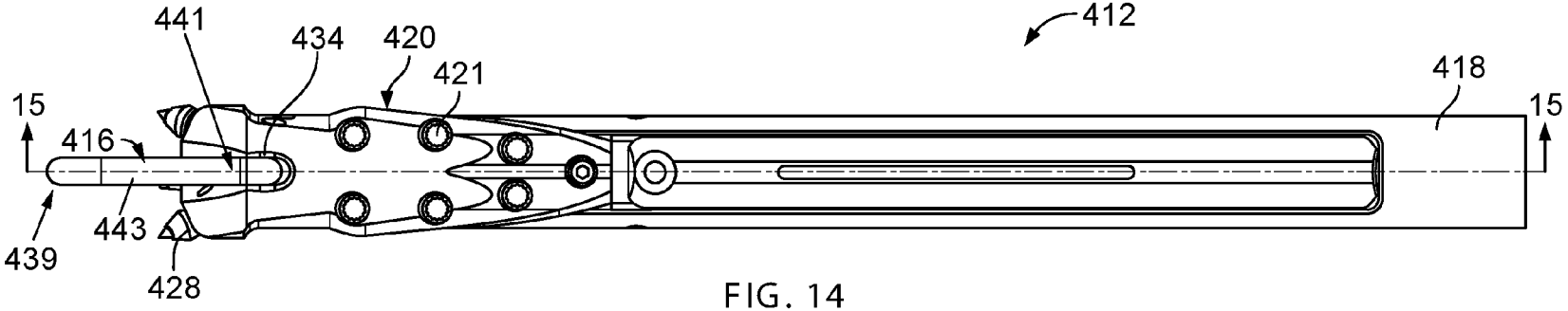
FIG. 14 illustrates a top view of the drilling tool and pullback device of FIG. 11.

FIG. 14 shows a top view of the drilling tool 412. As shown, the pullback device passage 434 is positioned to generally bisect the drill bit 420.

Figure 15:
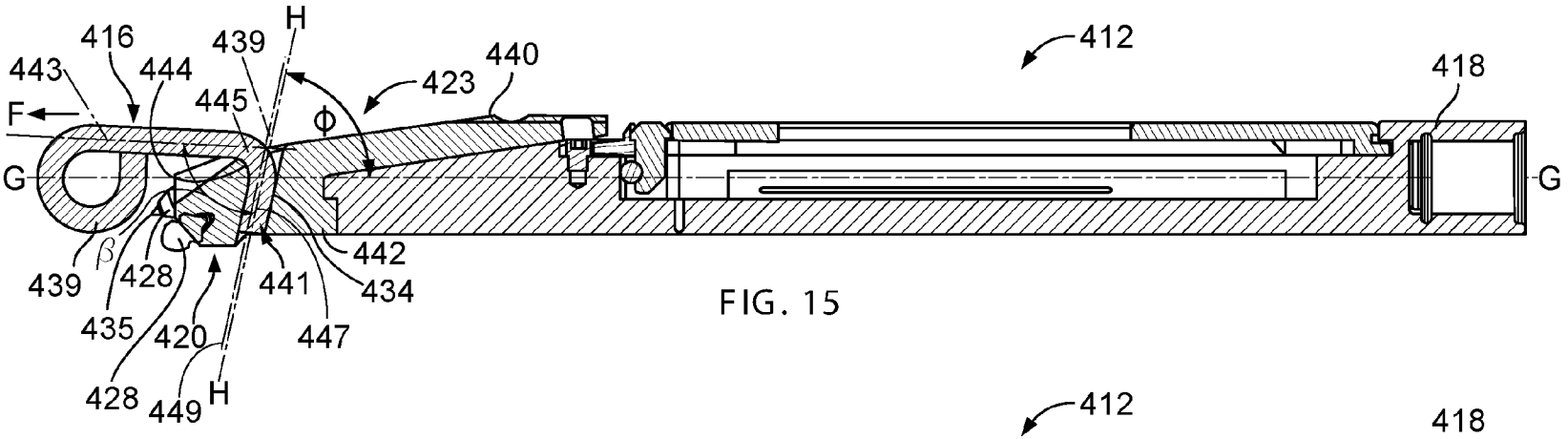
FIG. 15 illustrates a cross-sectional side view of the drilling tool and pullback device of FIG. 11.
Figure 16:
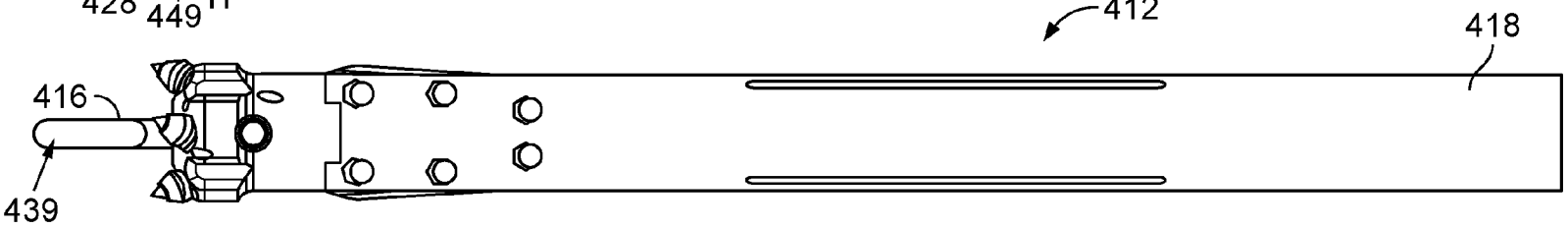
FIG. 16 illustrates a bottom view of the drilling tool and pullback device of FIG. 11.

A cross-sectional view of drilling tool 412 is shown in FIG. 15. As shown, the drill bit 420 is configured to receive a portion of the pullback device 416. The pullback device 416 is, in one variant, a rigid, inflexible, device that includes a first end 439 that includes a pulling loop and a second end 441 that is a hook shape. The first end 439 and the second end 441 are connected by a generally linear portion 443. In some embodiments, the pullback device 416 is manufactured from steel. The second end 441 of the pullback device 416 is shown to be positioned within the pullback device passage 434, and then secured within the drilling tool 412. The hook shape of the second end 441 securely maintains the pullback device 416 within the drilling tool when a force F is exerted on the pullback device 416 in a generally axial direction away from the drilling tool 412.

The hook shape of the second end 441 includes a hook curved portion 445 and an extension 447 extending from the hook curved portion 445. The extension 447 defines a hook axis 449. In some embodiments, the hook axis 449 forms an acute angle β with the linear portion 443 of the pullback device 416.

Further, the shape and orientation of the pullback device passage 434 also assists in retaining the pullback device 416 in the drilling tool 412. The pullback device passage 434 is shown to extend through the drill bit 420 from a top side 440 of drill bit 420 to the bottom side 442. The pullback device passage 434 extends generally along a pullback device passage axis H that extends through the drill bit 420 and is positioned at an angle Φ with a longitudinal axis G of the drilling tool 412. In some embodiments, the hook axis 449 is aligned with the pullback device passage axis H when the pullback device 416 is installed in the pullback device passage 434. In some embodiments, the angle Φ is an acute angle. In other embodiments, the angle Φ can be between about 105 degrees and about 90 degrees. When the angle Φ is less than or equal to 90 degrees, forces in a direction away from the drilling tool 412 along the pullback device 412 are minimized so that the pullback device 416 is biased toward retention in the drilling tool 412 during a pullback operation.

Figure 17:
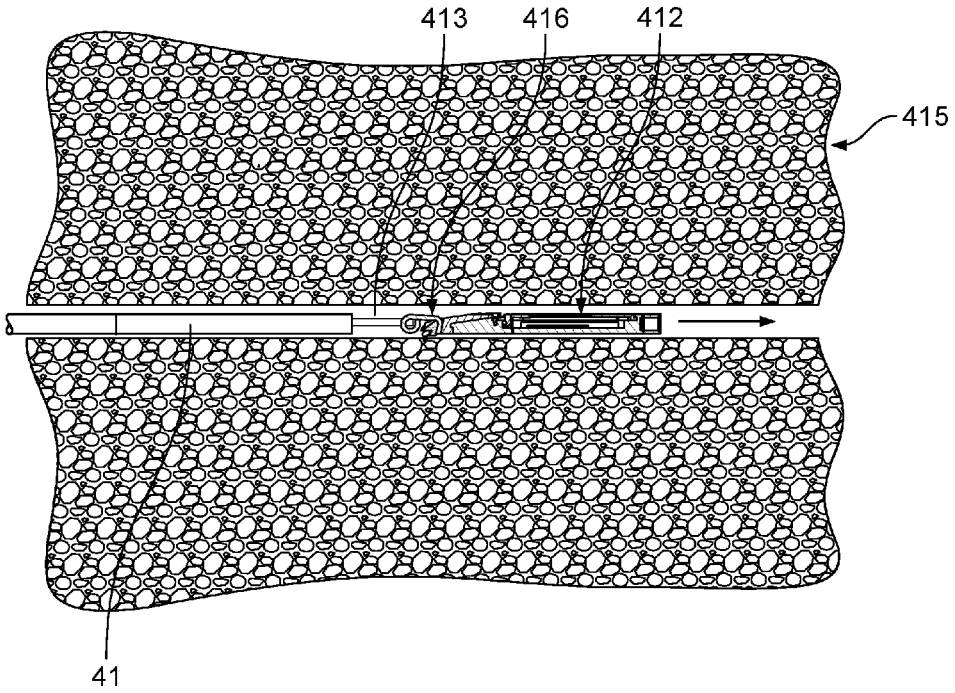
FIG. 17 illustrates a cross-sectional schematic view of the drilling tool and pullback device of FIG. 11 in a bore hole.

When the angle Φ is between about 105 degrees and about 90 degrees, forces in a direction away from the drilling tool 412 along the pullback device 412 are minimized. A cross-sectional schematic view of a bored hole 413 in ground 415 is shown FIG. 17. Because the pullback device 416 is attached to the drilling tool 412 that is used to bore the hole 413 in the depicted embodiment, the pullback device 416 is also retained within the drilling tool 412 during a pullback operation by the bore hole 413. Because the pullback device 412 must be at least partially lifted, or moved generally perpendicular to the longitudinal axis of the drilling tool 412, the size of bore hole 413 retards such movement due to its diameter being similar to that of the drilling tool 412. Therefore, even if forces in a direction away from the drilling tool 412 along the pullback device 412 exist, the bore hole 413 helps to retain the pullback device 416 within the drilling tool 412. Further, a certain level of friction exists between the second end 441 of the pullback device 416 and the pullback device passage 434 that will further promote retention of the pullback device 416 within the pullback device passage 434.

The pullback device passage 434 also includes a curved portion 444 adjacent to the top side 440 that curves as the surface extends in a direction along the pullback device passage axis H, aiding in minimizing stress risers at this transition region. In the depicted embodiment (i.e., where angle Φ is acute), the portion of the pullback device passage 434 nearest the top side 440 is a greater a distance away from a tip 435 of the drill bit than a portion of the pullback device passage 434 nearest the bottom side 442. In the depicted embodiment, the tip 435 is defined by the most distally positioned tooth 428.

Like the curved portion 144 described above, the curved portion 444 is configured to aid in reducing unnecessary friction and/or the presence of a sharp edge between the pullback device 416 and the drill bit 420. In some embodiments, the curved portion 444 is configured to interface with the hook curved portion 445 of the second end 441 of the pullback device 416. In some embodiments, a low friction insert and/or coating (not shown) may be in pullback device passage 434 at the opening of the pullback device passage 434 to further reduce friction between the pullback device 416 and the drill bit 420. In some embodiments, a beveled portion is used instead of a curved portion 444. In other embodiments, the pullback device passage 434 may have countersunk portion.

The pullback device 416 is sufficiently inflexible and strong enough (e.g., material choice, cross-sectional dimensions, etc.) to be thereby and configured to withstand downhole conditions and deformation during a pullback operation. Further, the pullback device 416 is configured to be reusable for multiple pullback operations. In some embodiments, the pullback device 416 has a Modulus of Elasticity between about $10\times10^6$ psi and about $32\times10^6$ psi. In yet a further embodiment, the pullback device 416 may be made of a steel or another material with a similar or higher Modulus of Elasticity.

Figure 18:
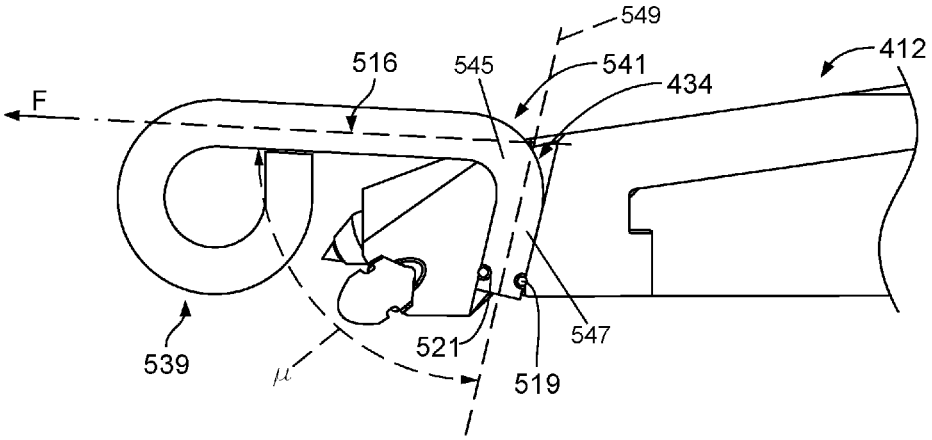
FIG. 18 illustrates a cross-sectional side view of a drilling tool and pullback device, according to one aspect of the present disclosure.

FIG. 18 shows a cross-sectional view of a drilling tool 412 configured to receive a pullback device 516 in the pullback device passage 434.

The pullback device 516 is similar to the pullback device 416 described above. In one variant, the pullback device 516 is a rigid, inflexible, device that includes a first end 539 that includes a pulling loop and a second end 541 that is a hook shape. The first end 539 and the second end 541 are connected by a generally linear portion 543. In some embodiments, the pullback device 516 is manufactured from steel. The second end 541 of the pullback device 516 is shown to be positioned within the pullback device passage 434, and then secured within the drilling tool 412. The hook shape of the second end 541 helps maintain the pullback device 516 within the drilling tool 412 when a force F is exerted on the pullback device 516 in a generally axial direction away from the drilling tool 412. Further, the pullback device 516 includes a spring ring 519 positioned in a groove 521 at the second end 541 to help retain the pullback device 516 within the drilling tool 412, effectively promoting a friction and/or a force fit within the pullback device passage 434. The spring ring 519 is just one example of a non-threaded retention element. The non-threaded retention element is not restricted to the spring ring 519.

The hook shape of the second end 541 includes a hook curved portion 545 and an extension 547 extending from the hook curved portion 445. The extension 547 defines a hook axis 549. In some embodiments, the hook axis 549 forms an acute angle μ with the linear portion 543 of the pullback device 516.

Figure 19:
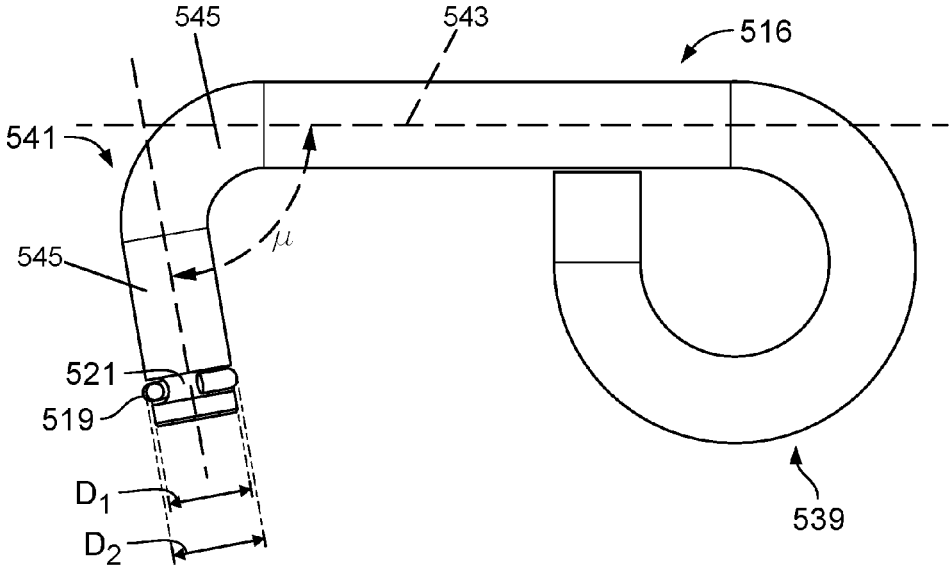
FIG. 19 illustrates a side view of the pullback device of FIG. 18.
Figure 20:
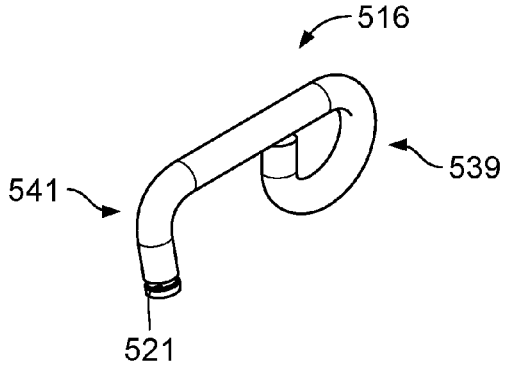
FIG. 20 illustrates a perspective view of the pullback device of FIG. 18 without a spring ring.
Figure 21:
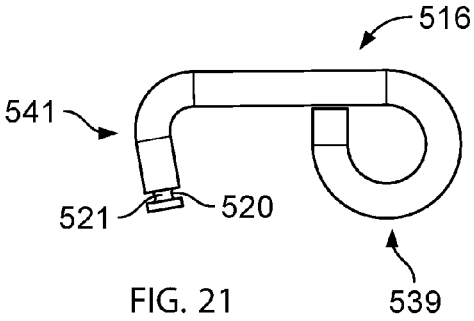
FIG. 21 illustrates a side view of the pullback device of FIG. 18 without a spring ring.
Figure 22:
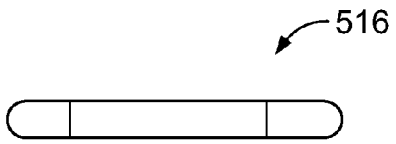
FIG. 22 illustrates a top view of the pullback device of FIG. 18 without a spring ring.
Figure 23:
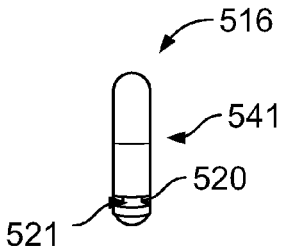
FIG. 23 illustrates a front view of the pullback device of FIG. 18 without a spring ring.

FIG. 19 shows a side view of the pullback device 516 with the spring ring 519 installed in groove 521. The pullback device 516 is shown uninstalled from the drilling tool 412. As shown, the second end 541 of the pullback device 516 has a diameter D1, and the spring ring 519 has a diameter D2. When not installed in the drilling tool 412, D2 is greater than D1. Once installed in the pullback device passage 434 of the drilling tool 412, the spring ring 519 is compressed to a diameter that is less D2 and equal to or greater than D1.

FIGS. 20-23 show multiple views of the pullback device 516 without the spring ring 519 installed in the groove 521. As shown, the groove 521 is disposed in the surface of the pullback device 516 at the second end 541. The groove 521 has a trough 520 that has a generally rounded profile. The trough 520 portion has a diameter less than the diameter D1 of the second end 541.

Figure 24:
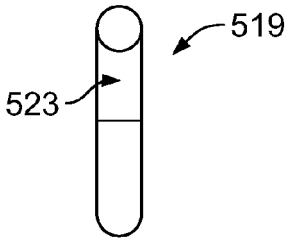
FIG. 24 illustrates a front view of the a spring ring for the pullback device of FIG. 18.
Figure 25:
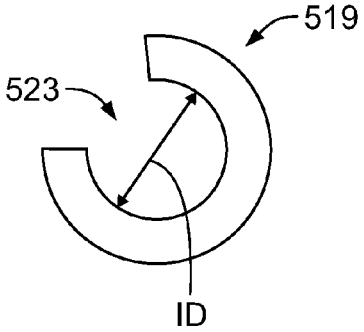
FIG. 25 illustrates a side view of the spring ring of FIG. 24.
Figure 26:
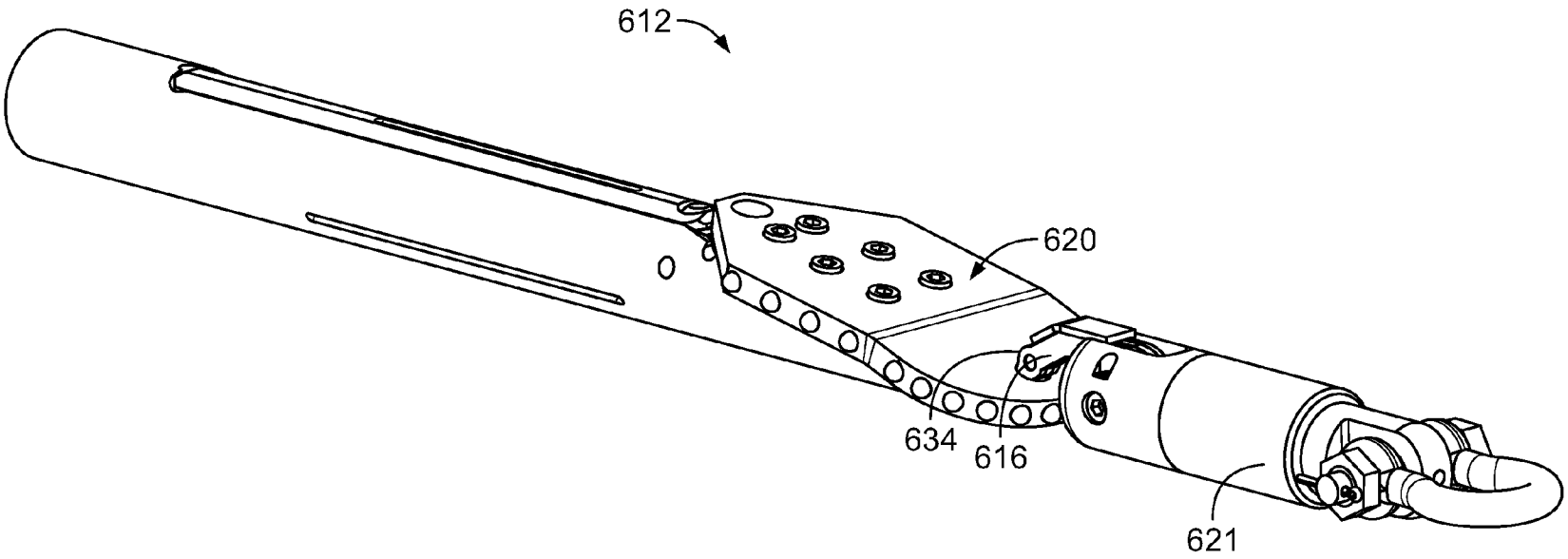
FIGS. 26-29 illustrate a drilling tool and a pullback device, according to one embodiment of the present disclosure.
Figure 27:
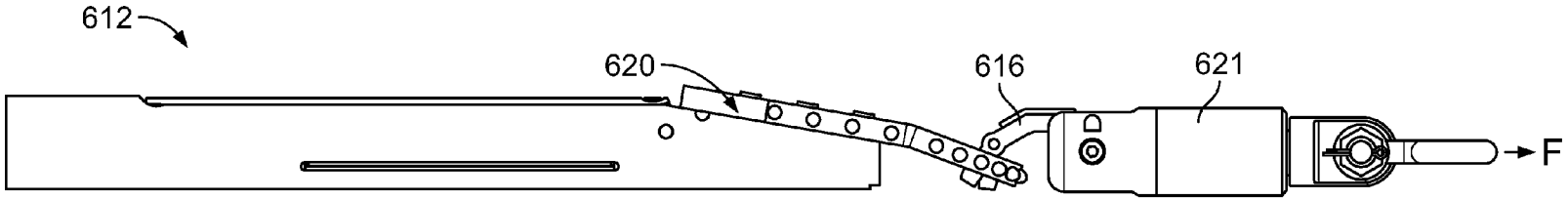
Figure 28:
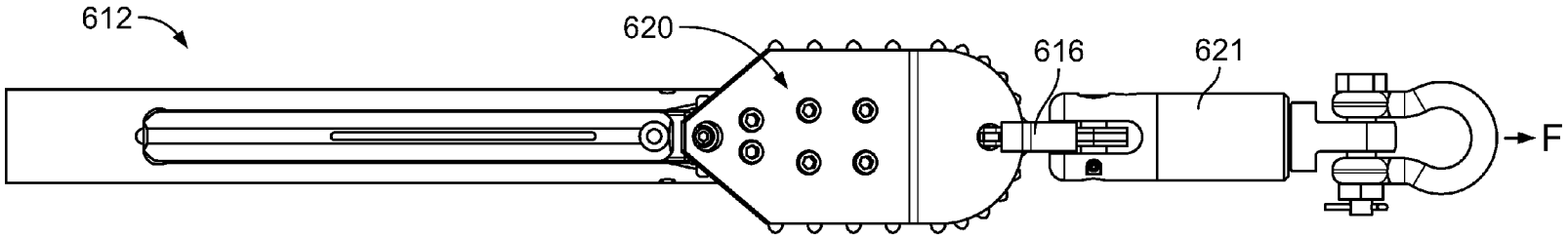
Figure 29:
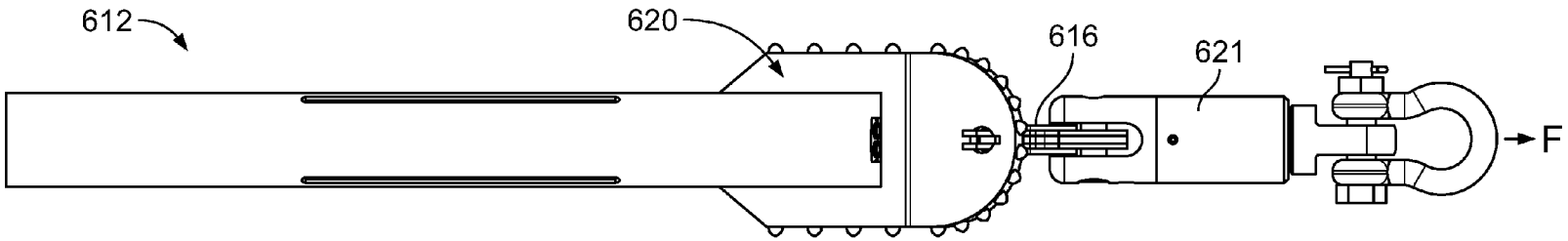

FIGS. 24 and 25 show the spring ring 519. The spring ring 519 has a generally circular cross-section and is configured to seat in the groove 521. The spring ring 519 includes an opening 523 to allow the spring ring 519 to be compressed and clipped in the groove 521. When uncompressed, the spring ring 519 has an inner diameter ID. The inner diameter ID of the spring ring 519 is greater than the diameter of the trough 520 of the groove 521, but less than the diameter D1 of the second end 541 of the pullback device 516. Once seated in the groove 521, the spring ring 519 is positioned loosely around the groove 521.

As described above, when the spring ring 519 is installed on the pullback device 516, and the pullback device 516 is installed in the drilling tool 512, the spring ring 519 is compressed. The opening 523 of the spring ring 519 allows for such compression. Once compressed, the inner diameter ID is decreased. In the depicted embodiment, the spring ring 519 has a compressed shape and an uncompressed shape. The spring ring 519 is constructed from a material that allows the spring ring 519 to return to the uncompressed shape after being in its compressed shape. By having such elastic behavior, the spring ring 519 exerts a force on the pullback device passage 434 when installed in the drilling tool 412. This force, along with the fact that the spring ring 519 is retained on the pullback device 516 by the groove 521, helps to retain the pullback device 516 within the pullback device passage 434 of the drilling tool 412. Different materials can be used to construct the spring ring 519 to alter the retaining force the spring ring 519 exerts in the pullback device passage 434 when installed in the drilling tool 412.

Like the pullback device 416 described above, the pullback device 516 is sufficiently inflexible and strong enough (e.g., material choice, cross-sectional dimensions, etc.) to be thereby configured to withstand downhole conditions and deformation during a pullback operation. Further, the pullback device 516 is configured to be reusable for multiple pullback operations. In some embodiments, the pullback device 516 has a Modulus of Elasticity between about $10\times10^6$ psi and about $32\times10^6$ psi.

FIGS. 26-29 show a drilling tool 612 having a drill bit 620 configured to receive a pullback device 616 in a pullback device passage 634. As shown, the pullback device 616 is configured to connect to the drill bit 620 with a swivel tool 621. In other embodiments, the pullback device 616 can connect the drill bit 620 with another tool or device.

The pullback device 616 is configured to be removably positioned within the device passage 634 of the drill bit 620. When positioned within the device passage 634, the pullback device 616 is locked within the passageway 634 so as to maintain the pullback device 616 within the drilling tool 612 when a force F is exerted on the pullback device 616 in a generally axial direction away from the drilling tool 612

Figure 30:
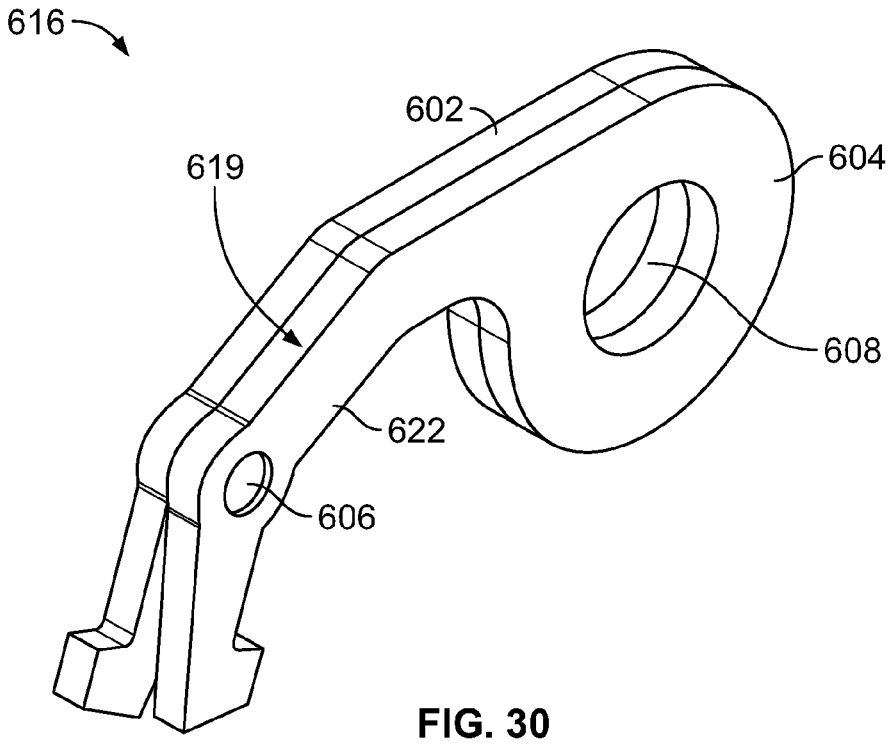
FIGS. 30-31 illustrate the pullback device of FIG. 26 in a closed position.
Figure 31:
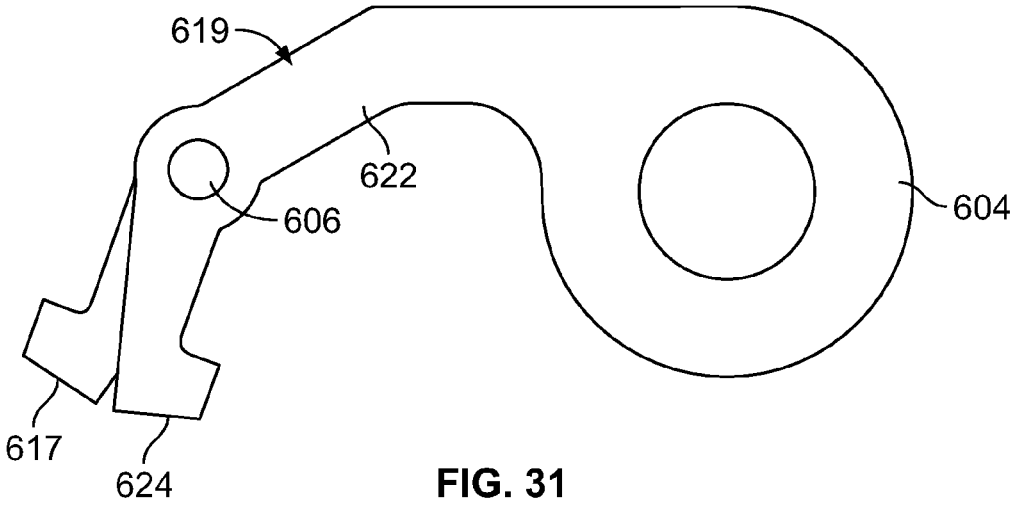
Figure 32:
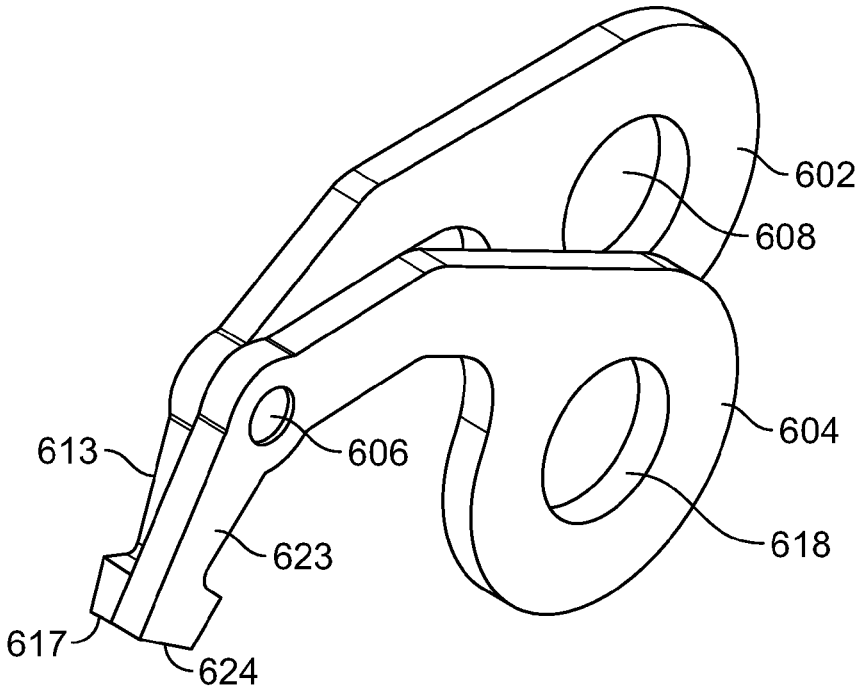
FIGS. 32-33 illustrate the pullback device of FIG. 26 in an open position.
Figure 33:
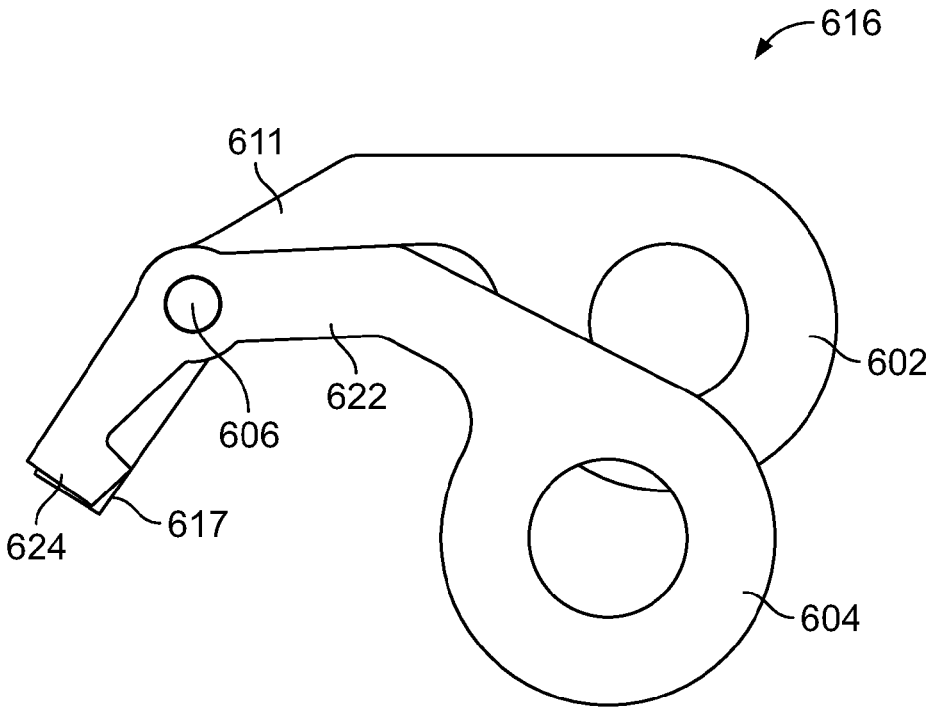

The pullback device 616 includes a first body 602 and a second body 604 pivotally connected together via a pivot pin 606. The pullback device 616 is movable between a closed position, as shown in FIGS. 30 and 31, and an open position, as shown in FIGS. 32 and 33. In one variant, the pullback device 616 is constructed of steel.

The first body 602 includes a retention loop 608 and a leg 610 extending from the retention loop 608. The leg 610 defines an upper leg portion 611 and a lower leg portion 613. The leg 610 includes a foot element 617 that extends from the lower leg portion 613. The lower leg portion 613 is angled away from the upper leg portion 611 in a first direction. The foot element 617 is located distal to the retention loop 608, and the foot element 617 extends from the lower leg portion 613 in the first direction.

In some embodiments, the second body 604 is a mirror image of the first body 602. The second body 604 includes a retention loop 618 and a leg 619 extending from the retention loop 618. The leg 619 defines an upper leg portion 622 and a lower leg portion 623. The leg 619 includes a foot element 624 that extends from the lower leg portion 623. The lower leg portion 623 is angled away from the upper leg portion 622 in a second direction. The foot element 624 is located distal to the retention loop 618, and the foot element 624 extends from the lower leg portion 623 in the second direction.

The pivot pin 606 links the leg 610 of the first body 602 to the leg 619 of the second body 604. The pivot pin is located at a location where the upper leg portion 611 of the first body 602 and the upper leg portion 622 of the second body 604 adjoin the lower leg portion 613 of the first body 602 and the lower leg portion 623 of the second body 604. The first body 602 is pivotally connected and thereby linked to the second body 604 in such a manner that the second direction of the foot 624 of the second body 604 is diametrically opposed to the first direction of the foot 617 of the first body 602.

To move between the closed and open positions, the first body 602 and the second body 604 are configured to be pivoted about one another. In the closed position, as shown FIGS. 30 and 31, the retention loop 608 of the first body 602 and the corresponding retention loop 618 of the second body 604 are generally aligned. Further, the upper leg portion 611 of the first body 602 and the corresponding upper leg portion 622 of the second body 604 are also generally aligned with one another, while the lower leg portion 613 of the first body 602 and the lower leg portion 623 of the second body 604 diverge from one another relative to the pivot pin 606. The foot 617 of the first body 602 and the foot 624 of the second body 604 each extend laterally beyond a space established by the lower leg portion 613 and the lower leg portion 623.

In the open position, as shown in FIGS. 32 and 33, the first body 602 and the second body 604 are pivoted so that the lower leg portion 613 of the first body 602 and the foot 617 are generally aligned with, respectively, the lower leg portion 623 of the second body 604 and the second foot 624. The retention loop 608 of the first body 602 and the retention loop 618 of the second body 604 are generally misaligned. Similarly, the upper leg 611 of the first body 602 and the upper leg 622 of the second body 604 are generally misaligned with one another.

Figure 34:
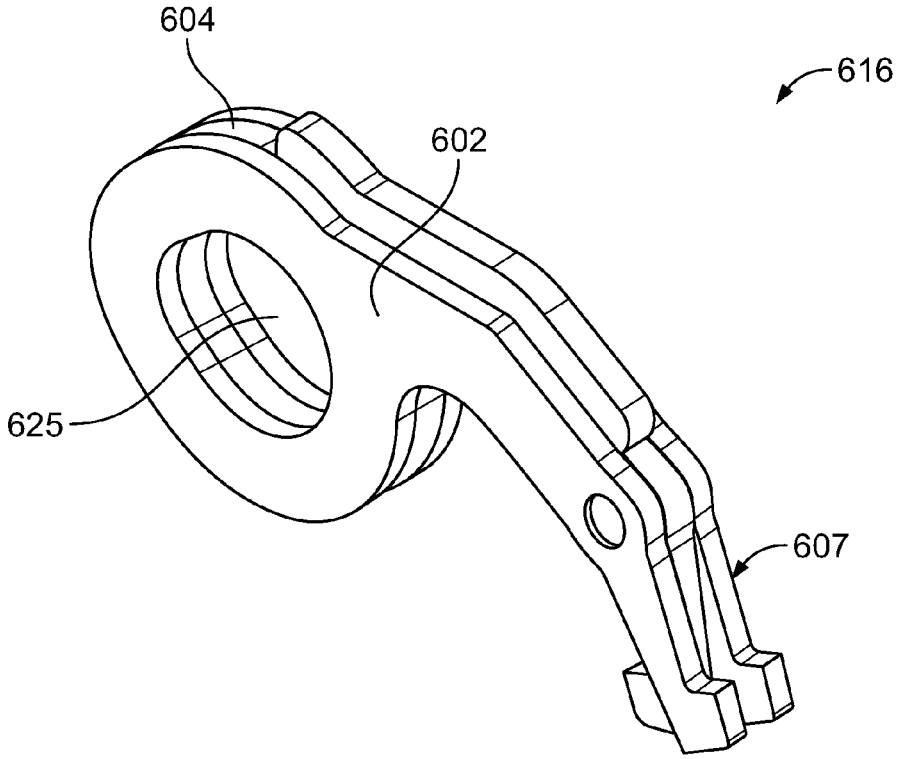
FIGS. 34-35 illustrate the pullback device of FIG. 26 with a third body in the closed position.
Figure 35:
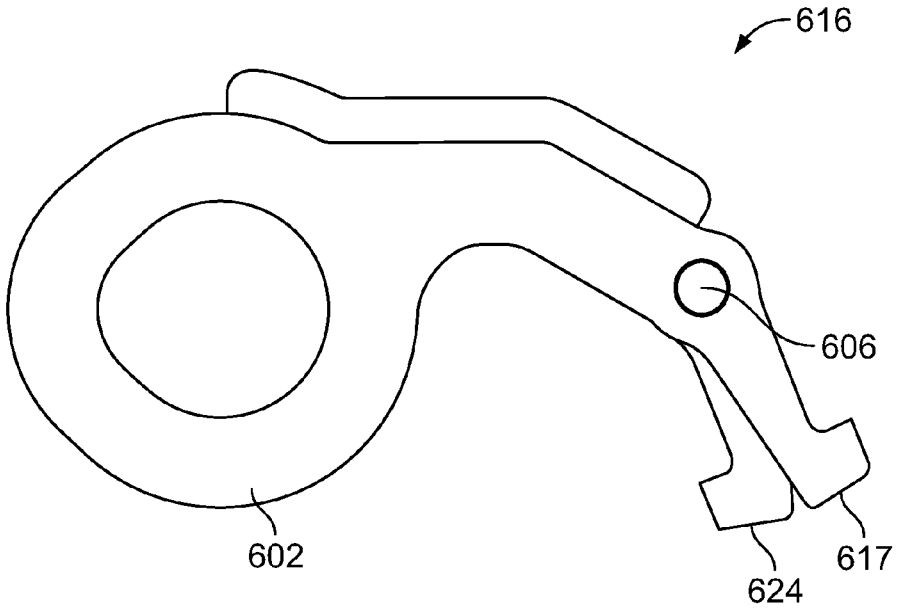
Figure 36:
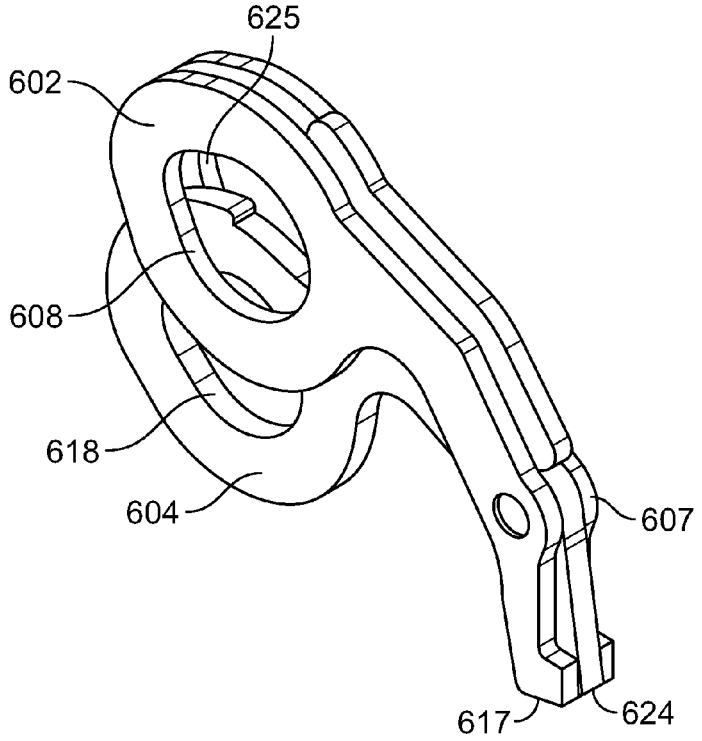
FIGS. 36-37 illustrate the pullback device of FIG. 26 with a third body in the open position.
Figure 37:
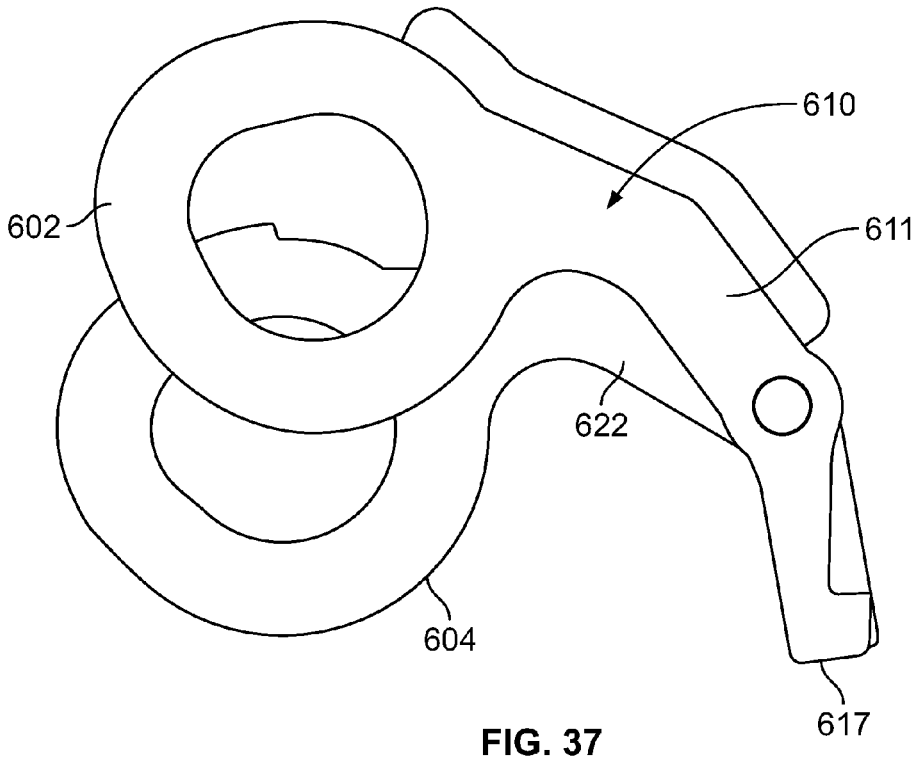

In some embodiments, the pullback device 616 includes a third body 607, as shown in FIGS. 34-37. Similar to the first and second bodies 602, 604, the third body 607 includes a retention loop 625 and a leg 626 extending from the retention loop 625. In some embodiments, the third body 607 is identical the first and second bodies 602, 604 and pivotally connected by the pivot pin 606 to the first and second bodies 602, 604. Further, as shown in FIGS. 33 and 34, when in the device 616 is in the closed position, the retention loops of the first, second, and third bodies are aligned. Further, as shown in FIGS. 35 and 36, when the device 616 is in the open position, the retention loops of the first, second, and third bodies are misaligned.

Figure 38:
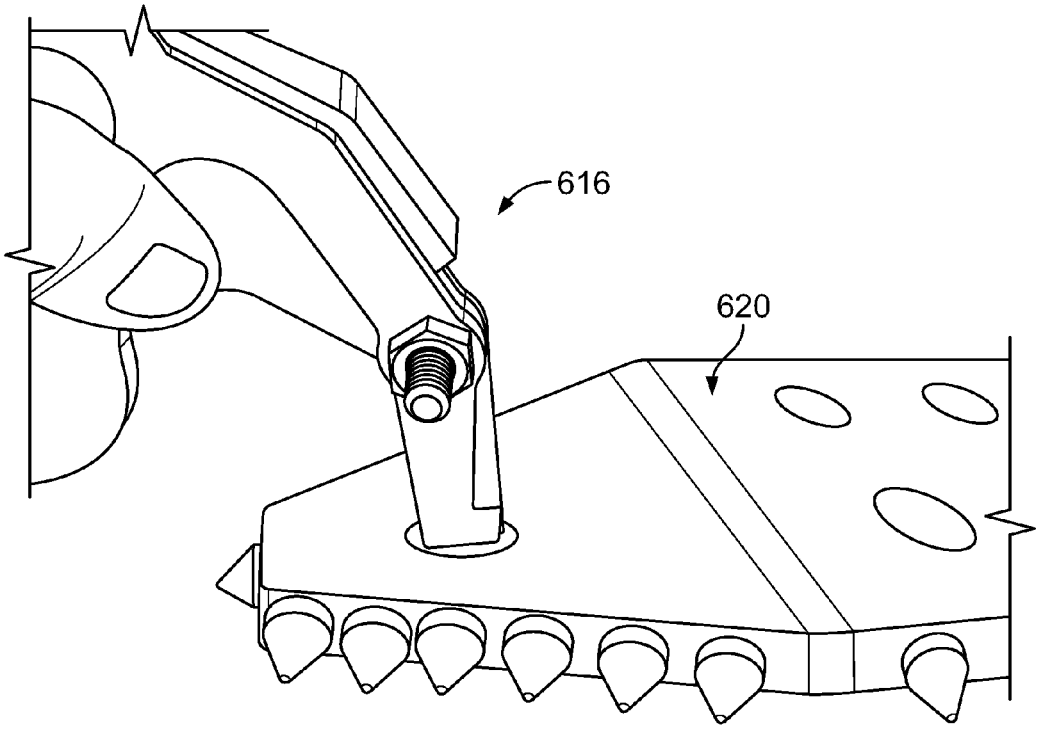
FIG. 38 illustrates the installation of the pullback device of FIG. 26.

As shown in FIG. 38, when the device 616 is installed on the drill bit 620 for a pullback operation, the first body 602 and the second body 604 (and in some embodiments, the third body 607) are first positioned in the open position to be inserted into the passageway 634 and then pivoted into the closed position to retain the pullback device 616 in passageway 634 within the drill bit 620. In some embodiments, a cross pin (not shown) can be used to lock the pullback device 616 in the closed position when the pullback device 616 is installed on the drilling tool 612.

In some embodiments, the pullback device 616 can be use in other applications, other than drilling. In some embodiments, the pullback device 616 can be used as a lifting device for towing vehicles, or other similar applications where a pulling device can be utilized.

For ease of explanation, various components have been described in directional terms such as "top," "bottom," "upwardly," and "downwardly" so as to provide relative frames of reference for describing the parts. These terms do not suggest that the disclosed apparatus is required to be used in a particular orientation. Quite to the contrary, during drilling operations, the drilling apparatus is rotated about a drill axis such that the directions in which the various parts of the drilling apparatus face are constantly changing. As used herein, "receptacles," "sockets," and "receivers" can be referred to as openings. In the depicted embodiment, the drill bit 120 is shown connected to the sonde housing 118. In alternative embodiments, the drilling tool 112 can be connected to other types of drive members such as rods, stems, subs, or other structures that do not contain sondes. In certain embodiments, carbide buttons are provided at various locations on the drill bits 120, 220 to limit wear and enhance drilling productivity.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

We claim:

1. A drilling tool system comprising:

a drill bit body carrying a plurality of cutting teeth, the drill bit body having a first side and an opposite second side, the drill bit body defining a first pullback device passage that extends through the drill bit body from the first side to the second side, the first pullback device passage extending generally along a passage axis that extends through the drill bit body, wherein the drill bit body has a front end for engaging a ground surface, and wherein a portion of the first pullback device passage adjacent to the first side of the drill bit body is a greater distance away from the front end of the drill bit body than a portion of the first pullback device passage adjacent to the second side of drill bit body, wherein the passage axis of the first pullback device passage is positioned at an acute angle with a longitudinal axis of the drill bit body in a direction facing away from the front end; and a pullback device having a first end and a second end, the first end including an attachment feature that is configured for attaching a product to be pulled, the second end being positionable within the first pullback device passage, wherein the second end includes a non-threaded retention element configured to retain the second end within the first pullback device passage.

2. The drilling tool system of claim 1, wherein the pullback device is inflexible.

3. The drilling tool system of claim 1, wherein the first pullback device passage includes at least a portion adjacent to the first side that is at least one of a curved and beveled surface as the surface extends in a direction along the passage axis, the passage axis being positioned along a reference plane that generally longitudinally bisects the drill bit body, the second end of the pullback device including a curved portion that is configured to interface with the portion of the first pullback device passage that is at least one of curved and beveled.

4. The drilling tool system of claim 1, wherein the non-threaded retention element is a spring ring disposed in a groove at the second end, wherein the spring ring is configured to exert a retaining force within the first pullback device passage.

5. The drilling tool system of claim 1, wherein the second end retains the pullback device within the first pullback device passage when a force that is generally longitudinally aligned with the drill bit body is exerted on the first end of the pullback device in a direction away from the drill bit body.

6. The drilling tool system of claim 1, wherein the drilling tool further includes a sonde housing to which the drill bit body attaches.

7. The drilling tool system of claim 1, wherein the acute angle is between about 105 degrees and about 90 degrees.

8. The drilling tool system of claim 1, wherein the drill bit body includes a plurality of tooth pockets for securing drilling teeth to the drill bit body, wherein the pullback device passage does not intersect the tooth pockets.

9. A pullback device for a drilling tool for a horizontal directional drill, the pullback device comprising:

a first end having an attachment feature for attaching a product to be pulled by the horizontal directional drill; and an intermediate portion connecting the first end with a second end, the second end being positionable within a pullback device passage of a drilling tool, wherein the second end includes a non-threaded retention element positioned around an extension of the second end, the non-threaded retention element configured to retain the second end within the pullback device passage of the drilling tool, wherein the extension of the second end forms an angle with the intermediate portion, wherein the angle is an acute angle in a direction facing toward the first end.

10. The pullback device of claim 9, wherein the non-threaded retention element is disposed in a groove at the second end of the pullback device.

11. The pullback device of claim 9, wherein the non-threaded retention element is a spring ring.

12. The pullback device of claim 11, wherein the spring ring has an uncompressed state when not positioned within the pullback device passage of the drilling tool, and wherein the spring ring has an uncompressed outer diameter that is greater than a diameter of the second end of the pullback device.

13. A drilling tool comprising:

a drill bit body carrying a plurality of cutting teeth, the drill bit body having a first side and an opposite second side, the drill bit body defining a first pullback device passage that extends through the drill bit body from the first side to the second side, the pullback device passage being configured to receive a portion of a pullback device therein, the pullback device passage extending generally along a passage axis that extends through the drill bit body, wherein the drill bit body has a front end for engaging a ground surface, and wherein a portion of the first pullback device passage adjacent to the first side of the drill bit body is a greater distance away from the front end of the drill bit body than a portion of the first pullback device passage adjacent to the second side of drill bit body, wherein the passage axis of the first pullback device passage is positioned at an acute angle with a longitudinal axis of the drill bit body in a direction facing away from the front end; and wherein the drill bit body includes a plurality of tooth pockets for securing drilling teeth to the drill bit body, wherein the pullback device passage does not intersect the tooth pockets.

* * * * *